United States Patent [19]

Kliewer, Jr.

[11] 4,187,653

[45] Feb. 12, 1980

[54] STRUCTURAL MEMBERS AND JOINTS BETWEEN SUCH MEMBERS

[75] Inventor: Aron Kliewer, Jr., Blue Jay, Calif.

[73] Assignee: Fleetwood Enterprises, Inc., Riverside, Calif.

[21] Appl. No.: 903,078

[22] Filed: May 5, 1978

[51] Int. Cl.[2] ..... E04C 2/20; E04B 2/08

[52] U.S. Cl. ..... 52/98

[58] Field of Search ..... 52/309.11, 309.9, 592, 52/593, 309.5, 595, 589, 594, 309.4, 98, 309.6; 296/31 P

[56] References Cited

U.S. PATENT DOCUMENTS

| | | | |
|---|---|---|---|
| 2,887,732 | 5/1959 | Kloote | 52/309 |
| 3,003,810 | 10/1961 | Kloote | 52/309.11 |
| 3,077,703 | 2/1963 | Bergstrom | 52/595 |
| 3,367,076 | 2/1968 | O'Brian | 52/309.11 |
| 4,095,913 | 6/1978 | Pettersson | 52/593 |

FOREIGN PATENT DOCUMENTS

| | | | |
|---|---|---|---|
| 640453 | 2/1964 | Belgium | 52/309.9 |
| 2619020 | 11/1977 | Fed. Rep. of Germany | 52/309.9 |

*Primary Examiner*—John E. Murtagh
*Attorney, Agent, or Firm*—Edward D. O'Brian

[57] ABSTRACT

Effective, simple, easily assembled joints between adjacent ends of structural members such as stress-skin panels may be constructed by shaping the ends of such members so that they can be fitted together. Each of such structural members has a core located between two side members. The disclosed invention relates to identically shaping the interfitting ends of such members so that the cores between the side members include sloping walls spaced from the side members by spacing walls. One of the side members on each structural member is constructed so as to overlap a side member on the other structural member when the panels are fitted together. An adhesive is used to join all adjacent surfaces within the joint between such two members.

13 Claims, 3 Drawing Figures

STRUCTURAL MEMBERS AND JOINTS BETWEEN SUCH MEMBERS

CROSS-REFERENCE TO RELATED APPLICATIONS

None.

BACKGROUND OF THE INVENTION

The invention set forth in this specification pertains to new and improved structural members and to joints between such members.

At the present time increasing interest is being expressed in utilizing so-called stress-skin panels for all sorts of structural applications. Such panels are normally formed so as to include a comparatively weak rigid core such as a core of cellular or foamed polymer material laminated between two side members such as aluminum or similar metal side members. It is not considered that an understanding of the present invention requires a detailed discussion as to why such structural members are considered to be particularly desirable in many different applications.

In utilizing such structural members or panels various problems have been encountered in joining such structural members or panels together in an edge-to-edge relationship. This problem is considered to be much more significant than might normally be realized. Any joint between two such panels or structural members must be desirable from a structural standpoint so as to be capable of transmitting the loads encountered in a particular assembled structure. In addition, however, such a joint preferably should be of such a character that the heat and noise transmission through the joint is the same or substantially the same as such transmission through the panels or structural members. Further, because of labor costs any such joints between two structural members or panels must be of a comparatively simple character, must involve parts which can be manufactured at a comparatively nominal cost, and must be capable of being assembled with minimal difficulty by comparatively unskilled labor.

It is considered that various known prior art joints for joining various tyes of structural members together are not particularly satisfactory for use in connection with stress-skin type structural members or panels as are indicated in the preceding. A wide variety of different types of joints have, of course, been proposed and utilized in connecting members together. Some of such joints are indicated in a number of standard reference works such as the text *Engineer's Illustrated Thesaurus* by Herkimer, copyright 1952, Chemical Publishing Company, New York.

Such joints as are indicated in this text and in other similar reference works are all considered to be relatively undesirable for use with stress-skin structural members as are indicated in the preceding discussion. It is not considered necessary to discuss the reasons as to why all of such joints are undesirable for use with stress-skin panels or structural members in this specification. However, it is considered that an understanding of this invention will be facilitated by a brief discussion of known scarf and butt joints and splices since such joints and splices are closely related to the present invention.

In such joints and splices it is conventional to form the adjacent interfitting ends of the members being joined so that such ends have closely interfitting "Z" type shapes and to secure such ends together by overlapping or fish plates extending across the abutted ends of the members and secured to both of the members by known fasteners such as bolts. Such joints require that the ends of the members be formed with a reasonably close degree of precision. They require significant hand labor in connection with their assembly. Further, because of the fasteners used with such joints the heat and sound transmission through such joints is normally higher than the heat and sound transmission through the portions of the members adjacent to such joints. As a result of these and various other related considerations it is not considered that known scarf and butt type joints and splices are particularly suitable for use in connecting stress-skin structural panels or members together.

SUMMARY OF THE INVENTION

A broad object of the present invention is to provide new and improved structural members and more specifically, structural members having ends which are particularly adapted to be interfitted with corresponding ends which are particularly adapted to be interfitted with corresponding ends of adjacent structural members to form joints between such members. A closely related objective of the invention is to provide new and improved joints between adjacent structural members such as panels. The invention is also intended to provide structural members such as stress-skin members which can be manufactured at a comparatively nominal cost, which can be easily and conveniently assembled with corresponding members so as to create structurally desirable joints and which are desirable as far as heat and sound transmission are concerned. The invention is particularly concerned with such joints which may be easily, conveniently and quickly created by comprratively unskilled labor.

In accordance with this invention these objectives are achieved by the use of a structural member constructed so as to include a uniform cross-sectional configuration having sides, a first side member and a second side member, said side members being located against and secured to said sides of said core, said structural member having an end in which the improvement comprises: the end of said core adjacent to said end of said structural member including a first spacing wall located adjacent to said first side member, a second spacing wall located adjacent to said second side member, and a sloping wall located between and connecting said first and second spacing walls, said spacing walls extending inwardly from said side members toward the center region of said structural member located between said side members, said first spacing wall being located further from said end of said structural member than said second spacing wall, said first side member extending a sufficient distance from said first spacing wall so as to be capable of overlying the second side member of the end of another corresponding structural member which has been fitted into said end of said structural member, said sloping wall being located at an angle relative to said side members such that when the end of such another structural member is fitted into said end of said structural member the sloping walls of the structural members are held in engagement with one another by the first side member of each structural member engaging the second side member of the other structural member with the opposed spacing walls of the structural members being located separate and apart from one another.

BRIEF DESCRIPTION OF THE DRAWING

The invention is best more fully described with reference to the accompanying drawing in which:

FIG. 3 is a cross-sectional view which is similar to FIG. 1 showing two of such panels connected together by a specialized structural member which is capable of holding items such as an additional structural member, electric or telephone lines, water lines, or the like.

Figure 2:
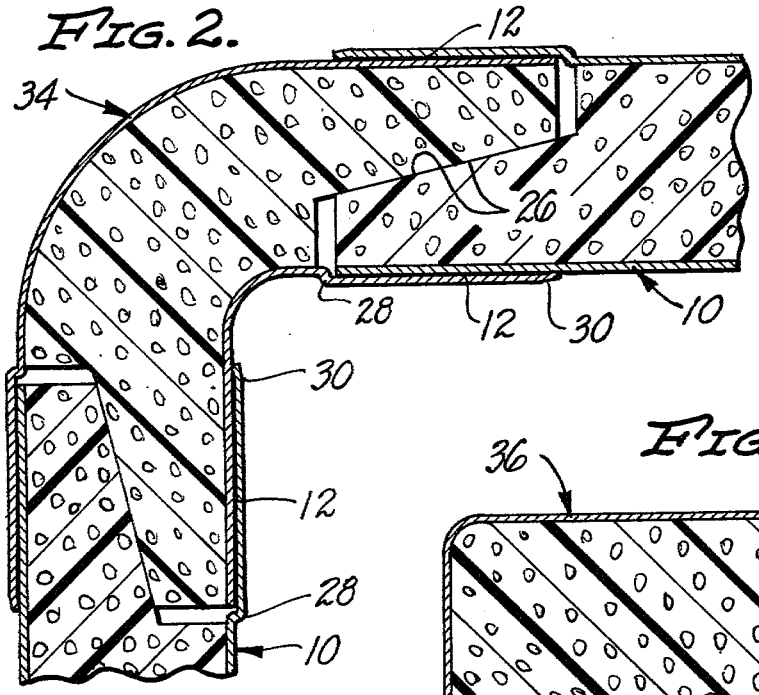
FIG. 2 is a similar cross-sectional view showing two of such panels connected together by a corner structural member.
Figure 3:
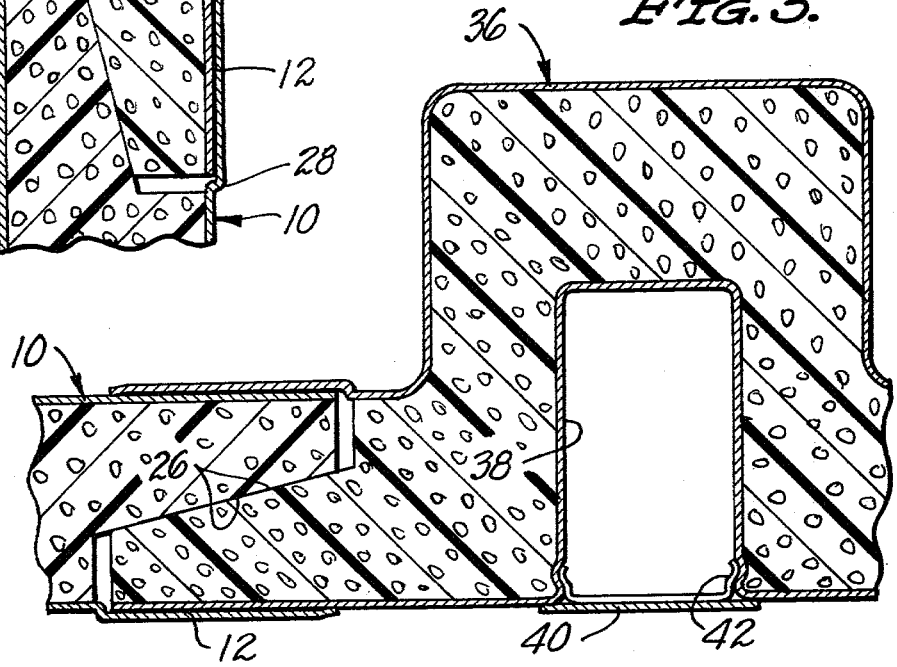

Since the accompanying drawing is merely intended to facilitate an understanding of the invention it does not indicate various structural members in accordance with this invention drawn to any particular scale. The particular joint structure illustrated in FIG. 1 of the drawing may be referred to as a preferred embodiment or mode of practicing the invention since it is utilized in connecting flat panels serving as structural members in a frequently utilized end-to-end relationship. For various different applications various specialized structural members such as are illustrated in FIGS. 2 and 3 are used in connecting such panels. All of the various structural members or joints illustrated in the drawing are considered to involve the principles or features of this invention as verbally set forth in the appended claims. These principles or features can be utilized in various different ways and in various different applications through the use or exercise of routine engineering skill.

DETAILED DESCRIPTION

Figure 1:
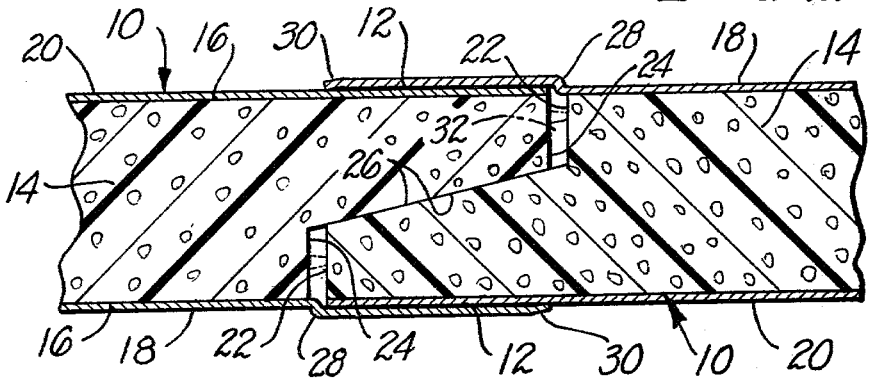
FIG. 1 is a cross-sectional view showing the ends of two structural members—more specifically, stress-skin panels—connected together into a joint in accordance with this invention.

In FIG. 1 of the drawing there are shown two different stress-skin structural panels 10 having identically shaped ends (not separately numbered) which are abutted together and secured to one another by an adhesive 12 as hereinafter indicated so as to form a type of scarf and butt type joint (not separately numbered) between the two panels 10. Each of the panels 10 includes a comparatively light weight cellular core 14 of a material such as cellular polystyrene or polyurethane having parallel sides 16.

These sides 16 are secured to first and second flat, parallel side members or skins 18 and 20, respectively, in accordance with known manufacturing processes such as, for example, through the use of an appropriate conventional adhesive (not shown). Although these side members 18 and 20 can be constructed of many different materials which are desirable from a structural standpoint it is considered preferable in the practice of the present invention that these side members 18 and 20 be comparatively thin sheets of a somewhat resilient material such as aluminum.

At the ends (not separately numbered) of the panels 10 the cores 14 are provided with first spacing walls 22 adjacent to the first side members 18, second spacing walls 24 adjacent to the second side members 20 and sloping walls 26 extending between these spacing walls 22 and 24. These spacing walls 22 are oriented so as to extend substantially perpendicular to the side members 18 and 20 but if desired may be slightly non-perpendicular and they may be of a somewhat irregular shape. The spacing walls 22 are slightly wider than the walls 24.

It is considered important that these spacing walls 22 and 24 be shaped and dimensioned so as to provide a space or pocket (not separately numbered) between them when the panels 10 are fitted together as illustrated in FIG. 1 of the drawing so that the sloping surfaces 26 on these panels 10 abut against one another. As will be apparent from an examination of the drawing and the preceding the walls 26 are located at an acute angle with respect to the second side members or skins 20.

Although this angle can be varied within reasonably wide limits in practicing the present invention it is considered that preferred results in accordance with this invention are achieved when this angle is such as to form a self-holding junction between the panels 10 when these panels 10 are interfitted as shown. It will be recognized that the expression "self-holding" is an expression which is most commonly utilized in connection with tapers as are employed to mount one part or member on another part or member. A self-holding taper is defined as a taper which will cause a shank when firmly seated in a correspondingly shaped socket to tend to stay in place by friction owing to the small taper angle. This expression "self-holding" as used herein is intended to designate an angle between the walls 26 which will tend to hold the panels 10 together when these walls 26 are firmly seated against one another.

The precise angle required to achieve this self-holding action will vary in accordance with material within the cores 14 and the surface treatment of such material. In general it is considered that preferred results are achieved when the angle is about 6 degrees. However, it is considered that this angle may be considerably increased when the walls 26 are formed by cutting the cellular cores 14 indicated in the preceding so that open cells of the cellular material within these cores 14 are exposed along the entire surfaces including the lengths of the walls 26. The reasons for this relate to the frictional contact between the walls 26 when they are formed of a foamed polymer material having the exposed edges of air, gas pockets or cells within the cellular material.

The panels 10 are each constructed so that the first side members 18 extend from the spacing walls 22 a sufficient distance so as to terminate in a common plane (not shown) with the side members 20 and the spacing walls 24. These planes are perpendicular to the side members 18 and 20. As a result of this construction the second side members 20 extend far enough so as to reasonably protect the spacing walls 24 and the adjacent portions of the cores 14 against damage. Also as a result of this geometry the side members 18 extend sufficiently far from the spacing walls 22 so as to be able to be used in securing the adjacent panels 10 to one another with the first side member 18 on one panel 10 overlappng the second side member 20 on the other panel 10 when these panels 10 are fitted together as illustrated in FIG. 1.

From a consideration of the preceding it will be realized that when the panels 10 are fitted together in this manner that the first side member 18 on one panel 10 is essentially coplanar with the second side member 20 on the other panel 10. The word "essentially" is used here since the portion of the first side member 18 (not separately identified) which extends beyond a spacing wall 22 is not exactly coplanar but extends slightly outwardly around the second side member 20 of the other panel 10.

Although the side members 18 can be deformed during manufacture so as to fit around and closely adjacent to the side members 20 as the panels 10 are fitted together by locating beads 28 in the side members 18 adjacent to the spacing walls 22 as shown, the use of such beads 28 is not considered to be necessary when the side members 18 are formed of a resilient material as indicated in the preceding discussion. It is, however, considered preferable to form these side members 18 with bent over terminal lips 30 which will resiliently engage the side members 20 as the panels 10 are assembled since such lips provide for an effective clamping or holding action and since they tend to provide a relatively smooth exterior appearance.

It is believed that it will be apparent from the aforegoing that those portions (not separately numbered) of the side members 18 which extend beyond the spacing wall 22 serve two functions. They tend to provide what may be referred to as a socket (not separately numbered) for use in providing an overlap between the two panels 10. In addition they provide an overlap between the two panels 10 which can be utilized to transmit load forces from the adjacent side panels 18 and 20 when two panels 10 are assembled as noted. The lengths that the side members 18 extend from the walls 22 is only critical in the sense that these side members 18 must extend far enough so as to adequately exercise these two functions. It is considered that if the extending portions of the side members 18 which project beyond the spacing walls 22 extend less than half of the lengths or distances shown that these projecting portions of the side members 18 would not adequately exercise their functions as noted in this discussion.

In order for structural loads to be transmitted as indicated in the preceding discussion between the side members 18 and 20 these members must, of course, be connected to one another. Such connection is achieved through the use of an adhesive 12 as identified in the preceding discussion. The use of such an adhesive 12 is considered preferable over the use of conventional fasteners because such fasteners provide stress points in the side members 18 and 20 which are considered to be undesirable from a structural standpoint and because the presence of such fasteners tends to interfere with the uniformity of heat and sound transmission through the panels 10 in the areas where these panels 10 join one another.

These panels 10 are specifically constructed so that all abutting surfaces of them can be secured together through the use of an adhesive without the use of such an adhesive detracting from the structural characteristics of the panels 10 themselves. This can be illustrated by referring to a method of assembly of the two panels 10 illustrated in FIG. 1. During such assembly fluid adhesive may be coated on the abutting surfaces (not enumerated) of one of the panels 10 but is preferably coated and overlapped on the abutting and overlapping surfaces (not enumerated) of both of the panels 10. These panels 10 are then interfitted as shown.

As this occurs a wiping action will be exercised as the sloping surfaces 26 are forced together which will tend to force or wipe any excess adhesive 12 into the spaces (not separately numbered) between the spacing walls 22 and 24. An advantage of the invention is that the wiping action will also tend to push any undesired debris present into these same spaces. Concurrently the movement of the lips 30 relative to the side members 20 and the movement of these side members 20 within the side members 18 will also tend to remove excess adhesive 12 to the outsides of the panels 10 and into the noted spaces so that only adequate adhesive 12 to form a desired structural connection will be present. Such adhesive 12 will, of course, harden after the panels 10 are assembled together. By virtue of this type of construction the undesired consequences of the presence of any excess adhesive 12 over that necessary to bond the panels 10 together are avoided.

It is considered that on occasion the nature of a particular material in the cores 14 may permit the panels 10 to be forced together to an undesired extent. In order to avoid this eventuality it is possible to form on either the walls 22 or 24 small, elongated, flange-like ridges 32 which will abut against the opposing wall 22 or 24 in order to give an indication of when the panels 10 have been pushed together a desired extent during assembly. These ridges 32 are preferably comparatively fragile so as to be capable of breaking in localized areas in order to accommodate the presence of undesired debris.

In FIGS. 2 and 3 there are shown structural members 34 and 36 used in conjunction with panels 10 as described in the preceding discussion. These structural members 34 and 36 are constructed in substantially the same manner as the panels 10 so as to be of different shapes than these panels 10 for specialized applications. Because of the close relationship between the structural members 34 and 36 and the panels 10 various parts of these structural members 34 and 36 which correspond to various parts of the panels 10 are designated herein by the same numerals previously used to designate such parts and are not separately described herein.

From a mere cursory examination of FIG. 2 of the drawing it will be apparent that the structural member 34 is essentially a panel 10 formed in the shape of a right angle. This member 34 is obviously useful in connecting two of the panels 10 to one another at a right angle. The structural member 36 is somewat different in that it is essentially a panel 10 deformed so as to extend in a "U" shaped manner so as to provide a pocket 38 which can extend inwardly of either the first side member 18 or the second side member 20. This pocket 38 may be conveniently employed to contain a further structural member (not shown) such as an "I" beam or the like. This pocket 38 may also be utilized to contain water lines, telephone lines, electric lines, or the like (not shown) as may be reasonably required in any particular application. A closure 40 retained by spring clips 42 or equivalent means may be utilized to close off this pocket 38.

It is not to be assumed from the aforegoing that various types of electric lines, telephone lines and the like can only be utilized with a pocket such as the pocket 38. The space (not enumerated) between the spacing walls 22 and 24 on adjacent panels 10 should normally be no greater than is necessary to accommodate excess adhesive 12 and debris which may be undesirably present. Such space is normally large enough to accommodate at least one line of the type indicated and if desired such space may be increased deliberately so as to accommodate a plurality of such lines.

The joints described in the preceding are considered to be quite desirable for reasons as are indicated in earlier portions of this specification. They are useful in connection with both vertical and horizontal walls and in both utilizations provide an effective seal between panels or the like connected by these joints. It is considered that these joints are particularly beneficial because they do not utilize framing members or fasteners at the joint location. The absence of such parts allow the joints described to maintain their structural integrity when subjected to comparatively significant temperature changes. This is considered to be quite beneficial. In addition these joints are quite beneficial because they are constructed in such a way as to accommodate or compensate for dimensional variation such as is normally encountered as a result of manufacturing tolerances.

I claim:

1. A structural member constructed so as to include a flat core having sides, a first side member and a second side member, said side members being located against and secured to said sides of said core, said structural member having an end in which the improvement comprises:

the end of said core adjacent to said end of said structural member including a first spacing wall located adjacent to said first side member, a second spacing wall located adjacent to said second side member, and a sloping wall located between and connecting said first and second spacing walls, said spacing walls extending inwardly from said side members toward the center region of said structural member located between said side members, said first spacing wall being located further from said end of said structural member than said second spacing wall, said first side member extending a sufficient distance from said first spacing wall so as to be capable of overlying the second side member of the end of another corresponding structural member which has been fitted into said end of said structural member, said sloping wall being located at an angle relative to said side members such that when the end of such another structural member is fitted into said end of said structural member the sloping walls of the structural members are held in engagement with one another by the first side member of each structural member engaging the second side member of the other structural member with the opposed spacing walls of the structural members being located separate and apart from one another, said sloping wall being dimensioned relative to said spacing walls so as to provide a space between the first spacing wall of said structural member and a second spacing wall of the end of another corresponding structural member which has been fitted into said end of said structural member and so as to provide a space between the second spacing wall of said structural member and as first spacing wall of the end of another corresponding structural member which has been fitted into said end of said structural member.

2. A structural member as claimed in claim 1 wherein:

said second side member covers all of said side of said core adjacent to said second side member.

3. A structural member as claimed in claim 1 wherein:

at least the portion of said first side member extending from said first spacing wall is resilient so as to be capable of bending sufficiently so as to resiliently engage the second side member along the end of another corresponding structural member which has been fitted into said end of said structural member.

4. A structural member as claimed in claim 3 wherein:

the edge of said first side member remote from said first spacing wall includes a resilient lip capable of engaging firmly the second side member of said other structural member which has been fitted into said end of said structural member.

5. A structural member as claimed in claim 1 wherein:

said angle is such as to form a self-holding junction between said structural member and the end of another corresponding structural member which has been fitted into said end of said structural member.

6. A structural member as claimed in claim 1 including:

frangible lip means extending along the length of one of said spacing walls, said frangible lip means serving to limit the movement of another corresponding structural member as such other corresponding structural member is being fitted into said end of said structural member.

7. A structural member as claimed in claim 1 wherein:

said second side member covers all of said side of said core adjacent to said second side member, at least the portion of said first side member extending from said first spacing wall is resilient so as to be capable of bending sufficiently so as to resiliently engage the second side member along the end of another corresponding structural member which has been fitted into said end of said structural member, the edge of said first side member remote from said first spacing wall includes a resilient lip capable of engaging firmly the second side member of said other structural member which has been fitted into said end of said structural member, said angle is such as to form a self-holding junction between said structural member and the end of another corresponding structural member which has been fitted into said end of said structural member, and including frangible lip means extending along the length of one of said spacing walls, said frangible lip means serving to limit the movement of another corresponding structural member as such other corresponding structural member is being fitted into said end of said structural member.

8. A structural member constructed so as to include a flat core having sides, a first side member and a second side member, said side members being located against and secured to said sides of said core, said structural member having an end in which the improvement comprises:

the end of said core adjacent to said end of said structural member including a first spacing wall located adjacent to said first side member, a second spacing wall located adjacent to said second side member, and a sloping wall located between and connecting said first and second spacing walls, said core being formed of a rigid cellular material open cells of which are exposed along the length of said sloping wall, said spacing walls extending inwardly from said side members toward the center region of said structural member located between said side members, said first spacing wall being located further from said end of said structural member than said second spacing wall, said first side member extending a sufficient distance from said first spacing wall so as to be capable of overlying the second side member of the end of another corresponding structural member which has been fitted into said end of said structural member, said second side member covering all of said side of said core adjacent to said second side member, at least the portion of said first side member extending from said first spacing wall is resilient so as to be capable of bending sufficiently so as to resiliently engage the second side member along the end of another corresponding structural member which has been fitted into said end of said structural member, the edge of said first side member remote from said first spacing wall including a resilient lip capable of engaging firmly the second side member of said other structural member which has been fitted into said end of said structural member, said sloping wall being located at an angle relative to said side members such that when the end of such another structural member is fitted into said end of said structural member the sloping walls of the structural members are held in engagement with one another by the first side member of each structural member engaging the second side member of the other structural member with the opposed spacing walls of the structural members being located separate and apart from one another, said angle is such as to form a self-holding junction between said structural member and the end of another corresponding structural member which has been fitted into said end of said structural member, and including frangible lip means extending along the length of one of said spacing walls, said frangible lip means serving to limit the movement of another corresponding structural member as such other corresponding structural member is being fitted into said end of said structural member.

9. A structural member constructed so as to include a flat core having sides, a first side member and a second side member, said side members being located against and secured to said sides of said core, said structural member having an end in which the improvement comprises:

the end of said core adjacent to said end of said structural member including a first spacing wall located adjacent to said first side member, a second spacing wall located adjacent to said second side member, and a sloping wall located between and connecting said first and second spacing walls, said core being formed of a cellular material, open cells of which are exposed along the length of said sloping wall, said spacing walls extending inwardly from said side members toward the center region of said structural member located between said side members, said first spacing wall being located further from said end of said structural member than said second spacing wall, said first side member extending a sufficient distance from said first spacing wall so as to be capable of overlying the second side member of the end of another corresponding structural member which has been fitted into said end of said structural member, said sloping wall being located at an angle relative to said side members such that when the end of such another structural member is fitted into said end of said structural member the sloping walls of the structural members are held in engagement with one another by the first side member of each structural member engaging the second side member of the other structural member with the opposed spacing walls of the structural members being located separate and apart from one another.

10. A structural member as claimed in claim 9 wherein:

said side members are resilient metal members.

11. A joint between two structural members, each of which is constructed as claimed in claim 9, said structural members being located so that the end of one is fitted into the end of the other, said joints including an adhesive securing all adjacent surfaces of said structural member together.

12. A joint between two panels in which the improvement comprises:

each of said panels being a stress skin panel having flat, parallel resilient metal side members separated by a core filling the space between said skins, said panels being located so as to have abutting, identically shaped, interfitting ends, the core of each of said panels adjacent to said interfitting ends being shaped so as to include a first spacing wall located adjacent to a first of said side members, a second spacing wall located adjacent to a second of said side members and a sloping wall located between and connected to said first and second spacing walls, said cores are formed of a rigid, cellular material open cells of which are exposed along the length of said sloping walls, said spacing walls of said cores of both of said panels extending inwardly from said side members toward the center regions of said panels located between said skins of said panels, said first spacing wall on each of said panels being located further from the end of the panel on which it is located than the second spacing wall on such panel, said first side members on both of said panels overlying said second side members on the other of said panels, said sloping walls on said panels fitting closely against one another, adhesive means located between said first and second side members securing said first side members to said second side members, and adhesive means located between said sloping walls for securing said sloping walls to one another.

13. A joint as claimed in claim 12 wherein:

said sloping walls of said panels are located at angles relative to said skins such as to form a self-holding junction between said panels at said ends of said panels.

* * * * *